US005193613A

United States Patent [19]

Wallis

[11] Patent Number: 5,193,613

[45] Date of Patent: Mar. 16, 1993

[54] HEAT EXCHANGER HEADER TUBE AND METHOD OF MAKING

[76] Inventor: Bernard J. Wallis, 2215 Dacosta, Dearborn, Mich. 48128

[21] Appl. No.: 906,553

[22] Filed: Jun. 30, 1992

[51] Int. Cl.[5] ..... F28F 9/02; B21D 53/06

[52] U.S. Cl. ..... 165/173; 165/153; 165/175; 165/906; 29/890.043; 29/890.052

[58] Field of Search ..... 165/153, 173, 175, 176, 165/906; 29/890.052, 890.043

[56] References Cited

U.S. PATENT DOCUMENTS

| | | | |
|---|---|---|---|
| 1,993,390 | 3/1935 | Voss | 165/71 |
| 2,237,029 | 4/1941 | Fischer | 292/256.71 |
| 3,487,668 | 1/1970 | Fuchs, Jr. | 72/55 |
| 3,495,486 | 2/1970 | Fuchs, Jr. | 83/53 |
| 4,098,331 | 7/1978 | Ford et al. | 165/170 |
| 4,168,744 | 9/1979 | Knulle et al. | 165/154 |
| 4,582,127 | 4/1986 | Moranne | 165/83 |
| 4,615,385 | 10/1986 | Saperstein et al. | 165/175 |
| 4,825,941 | 5/1989 | Hoshino et al. | 165/110 |
| 4,960,169 | 10/1990 | Granetzke | 165/173 |
| 4,989,482 | 2/1991 | Mason | 83/22 |
| 5,052,478 | 10/1991 | Nakajima et al. | 165/153 |
| 5,088,193 | 2/1992 | Okada et al. | 29/890.052 |

*Primary Examiner*—John Rivell
*Assistant Examiner*—L. R. Leo
*Attorney, Agent, or Firm*—Barnes, Kisselle, Raisch, Choate, Whittemore & Hulbert

[57] ABSTRACT

A heat exchanger comprising opposed parallel header tubes having circumferentially spaced grooves along the length thereof with inclined sides and a base on the external surface of the groove and spaced annular ribs on the inner surface opposite the grooves. Each groove has a transverse slot therein for receiving open ends of an elongated flat tube. Each header tube is made by performing a rolling operation to form the grooves and ribs. Thereafter, the grooved tubes are punched to form the transverse slots in the base of the grooves.

8 Claims, 5 Drawing Sheets

HEAT EXCHANGER HEADER TUBE AND METHOD OF MAKING

This invention relates to a heat exchanger for use, for example, as a cooler in automobiles, and more particularly to a heat exchanger using a high pressure gaseous coolant.

BACKGROUND AND SUMMARY OF THE INVENTION

Known heat exchangers generally comprise two spaced headers with a plurality of parallel, open ended tubes interconnecting the headers for fluid communication with each other. Serpentine fins are generally disposed between the spaced flat tubes.

The manufacture of such heat exchangers generally require holes or openings to be formed in the surface of each header to receive the open ends of the flat tubes. Typically, this is accomplished by a punching operation which forms the opening. Examples of such prior heat exchangers are seen in U.S. Pat. Nos. 4,098,331 and 4,825,941.

One of the problems encountered in the manufacture of such heat exchangers is that the thin walled header tubes are subject to circumferential pressure or stress during the punching operation causing the tube to collapse. In order to maintain the integrity of the header tube, it has been required to perform the punching operation while pressurizing the inside of the tube with pressurized fluid, or a solid core as taught in U.S. Pat. Nos. 3,487,668 and 5,052,478.

In addition, another problem with respect to such a method of manufacture is that raw unfinished edges of the slots left by the punching operation interfere with the insertion of the flat tubes.

Among the objectives of the invention are to provide a heat exchanger with improved headers and a method of making such headers; a heat exchanger with header tubes whose surface has been strengthened to withstand a punching operation to form slots therein without the need to pressurize the inside of the headers and to prevent collapse thereof during the punching operation; a header tube which facilitates insertion of a plurality of tubes simultaneously; and which assume a high quality, leak-free, braze bond between the flat tubes and the header tubes.

According to the invention, the header tubes are strengthened by deforming the surface thereof at longitudinally spaced locations to form spaced annular grooves with inclined sides and a base on the external surface of the groove and spaced annular ribs on the inner surface opposite the grooves. The tubes are deformed by rollers which form the spaced grooves and ribs along the length of the tube for added strength. The tubes are then punched to form slots in the base of the grooves.

DESCRIPTION

Figure 1:
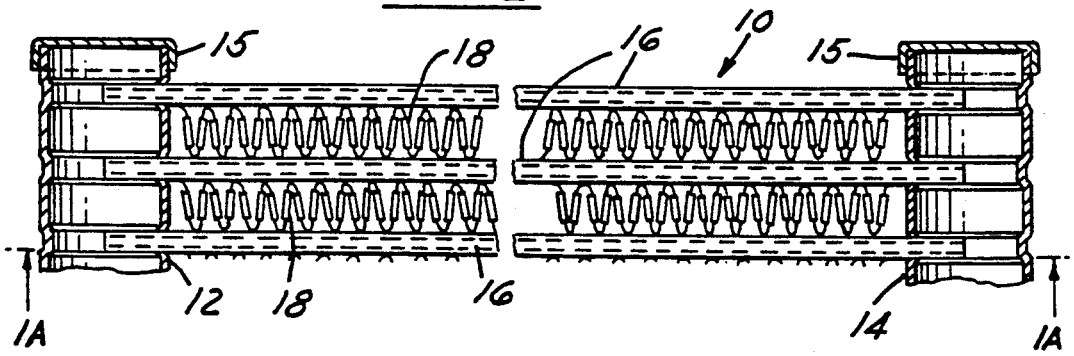
FIG. 1 is a fragmentary sectional view of an assembled heat exchanger.
Figure 1A:
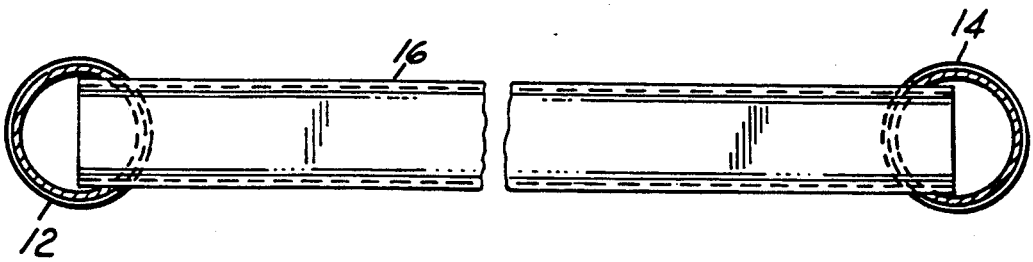
FIG. 1A is a view taken along the line 1A—1A in FIG. 1.

Referring to FIGS. 1, 1A, a heat exchanger assembly 10 embodying the invention comprises parallel metal header tubes 12, 14 which are preferably seamless cylindrical tubes. The ends of each header tube 12, 14 are closed and sealed by caps 15 which are bonded as by brazing to the header tube to provide a seal. Elongated flat metal tubes 16 with open ends which are in spaced parallel relation have their ends extending into slots in the header tubes 12, 14. In the known manner, serpentine fins 18 are disposed between each flat tube 16 and the header tubes 12, 14 and the headers, caps, tubes fins are bonded as by brazing.

The open ends of the flat tubes 16 communicate with the interior of the header tubes 12, 14 so that fluid may flow from a desirable source (not shown) through the header tubes 12, 14 and each flat tube 16.

Figure 2:
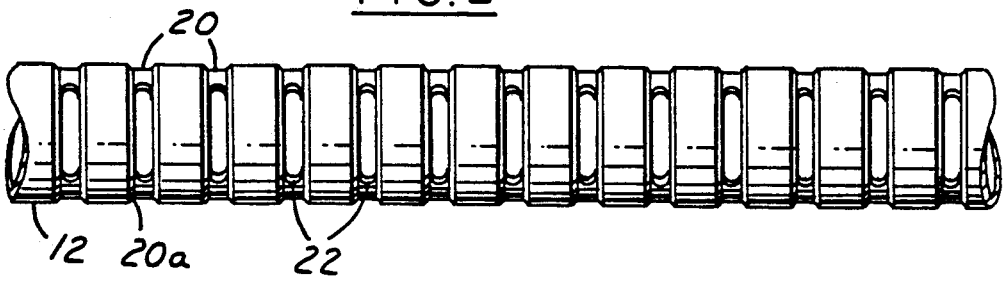
FIG. 2 is a fragmentary plan view of a formed and punched header tube.
Figure 3:
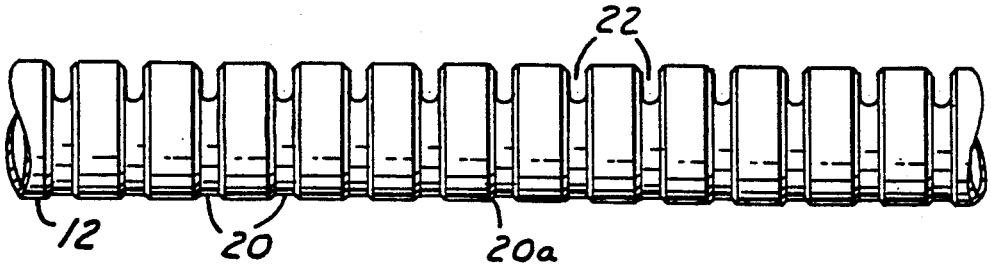
FIG. 3 is a fragmentary side view of the formed and punched header tube.
Figure 6:
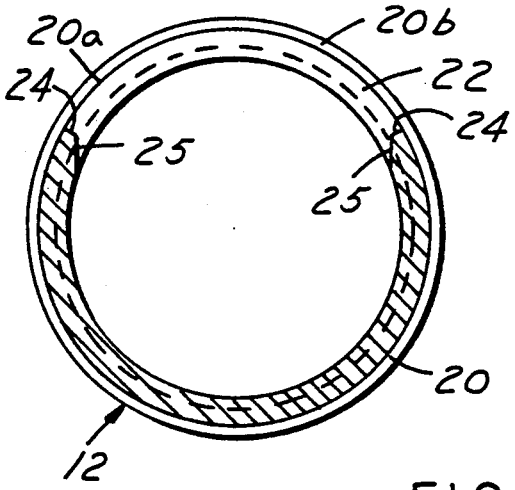
FIG. 6 is a sectional view taken along the line 6—6 in FIG. 4.

A portion of one of the header tubes 12 can be seen in FIGS. 2 and 3, where it is shown that the outer surface of the header tube 12 is provided along its length with the plurality of longitudinally spaced parallel annular grooves 20. Each groove 20 includes a base 20*a* and inclined walls 20*b*. On the inside surface of each tube, an annular rib 20*c* is formed opposite each groove 20. Base 20*a* may be flat or curved. Within each groove 20 an elongated transverse slot 22 is formed on the base 20*a* which extends about the periphery of the header tube 12 (FIG. 6).

Figure 7:
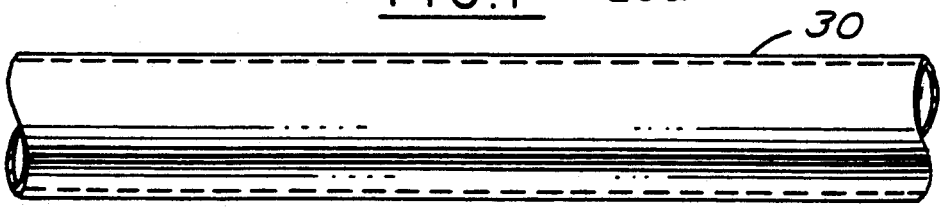
FIG. 7 is a fragmentary top view of a tube before forming.
Figure 8:
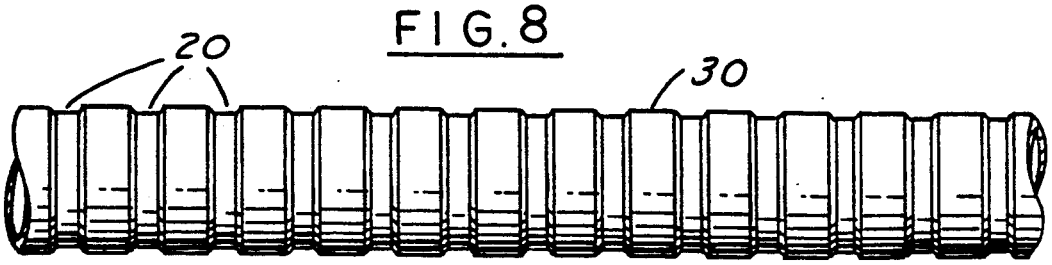
FIG. 8 is a fragmentary plan view of a tube with formed grooves before punching slots therein.

Each header tube 12, 14 is formed from a length of tubing 30 (FIG. 7). The tubing 30 is subjected to a rolling operation which forms the flat spaced annular grooves 20 and annular ribs 20*c* along the length of the tubing 30 (FIG. 8). The grooves 20 act as a circumferential stiffener to allow the tubing to be subjected to a punching operation without crippling or collapsing. The base 20*a* and inclined walls 20*b* of each groove 20 are formed by the rolling operation.

Figure 11:
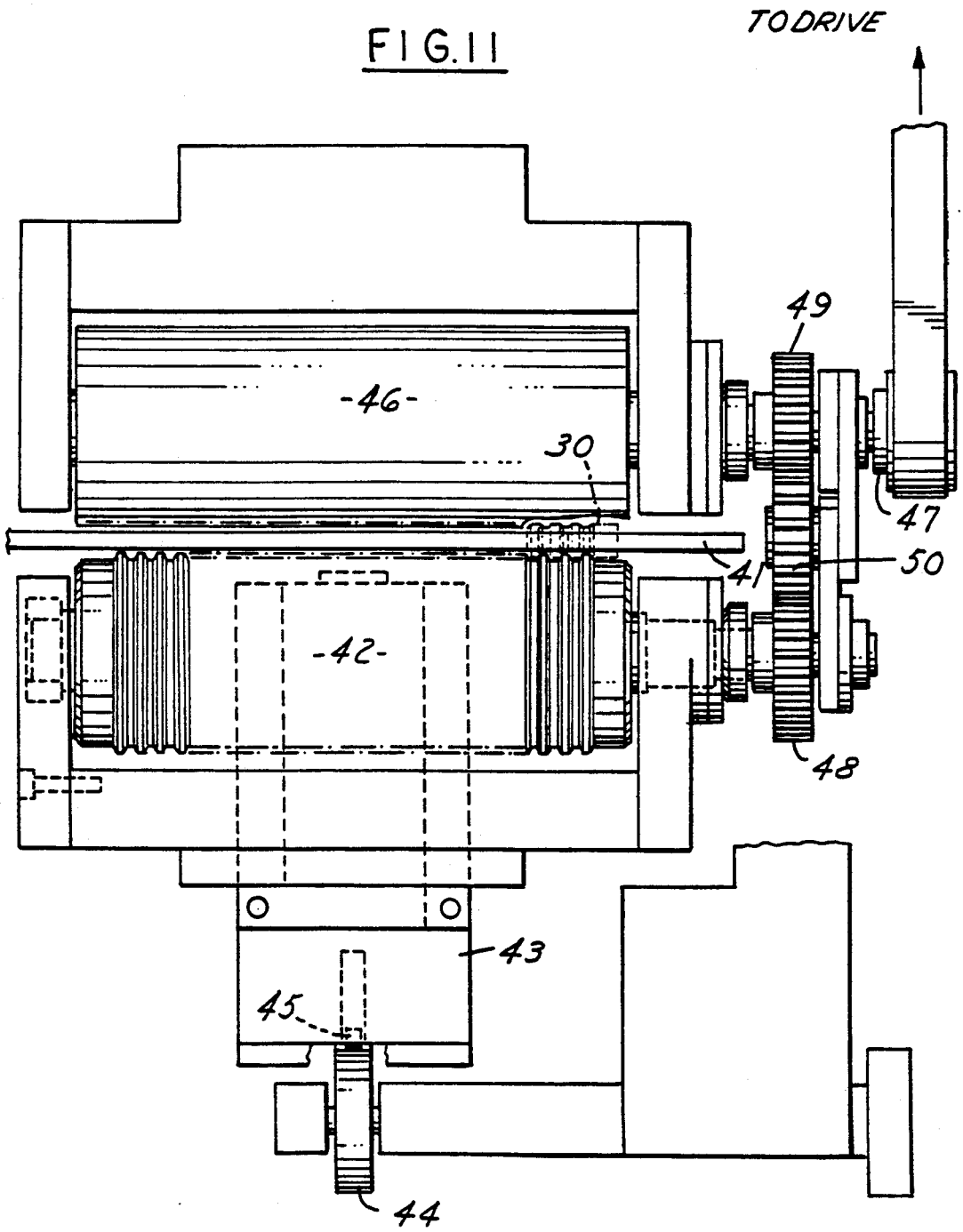
FIG. 11 is an end view of an apparatus for forming a tube.
Figure 12:
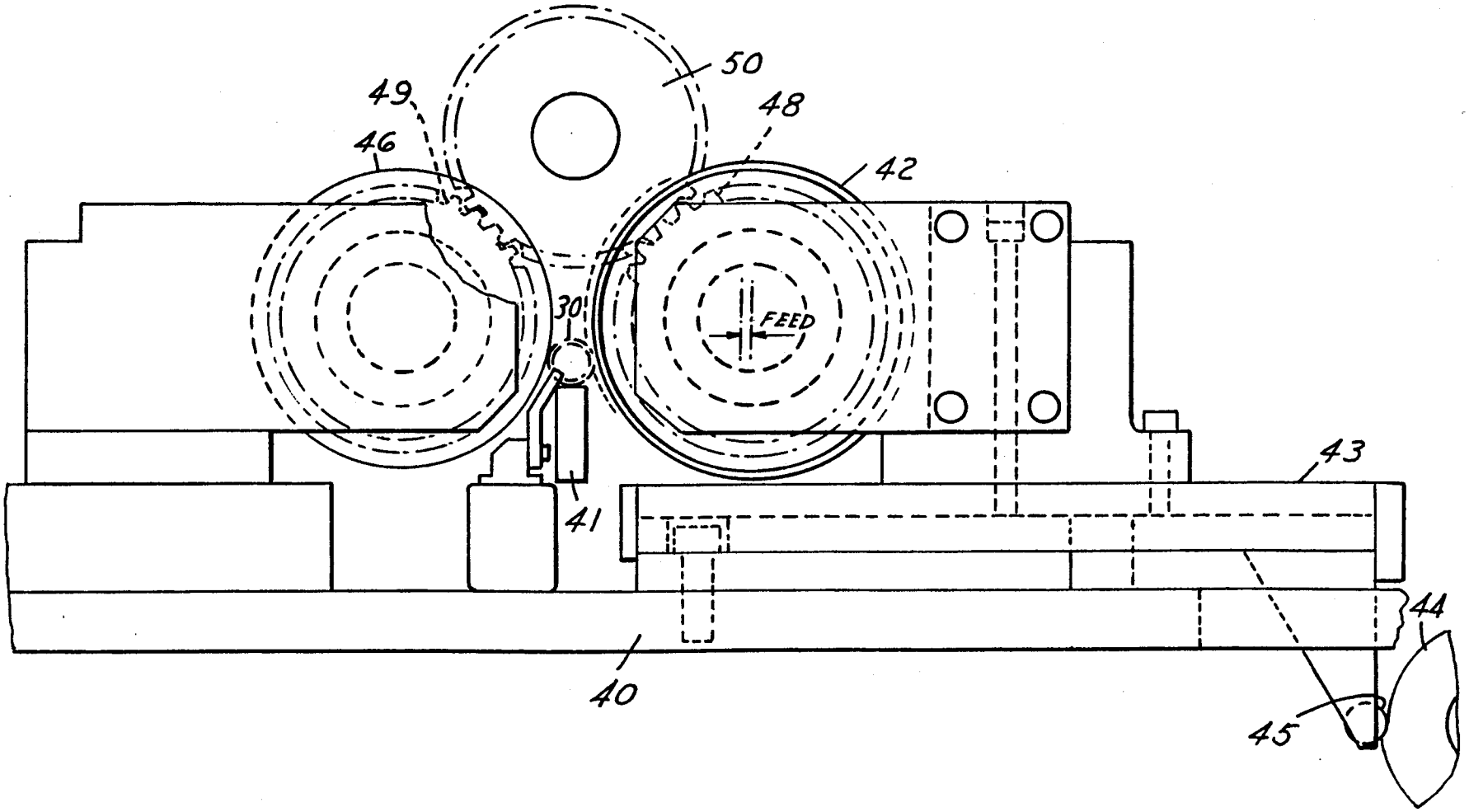
FIG. 12 is a plan view of the apparatus shown in FIG. 11.

Referring to FIGS. 11 and 12, an apparatus for forming the grooves 20 and ribs 20*c* is shown. The apparatus comprises a base 40 that supports a tube 30 to be formed on a support 41. A grooved die roll 42 is supported on a slide 43 that is moved toward and away from the tube 30 by a cam 44 acting on a roller 45 on slide 43. A smooth backup roll 46 is rotatably mounted on base 40 with its axis fixed. The die roll 42 and backup roll 46 are driven by a drive shaft 47 through gears 48, 49, 50.

Figure 4:
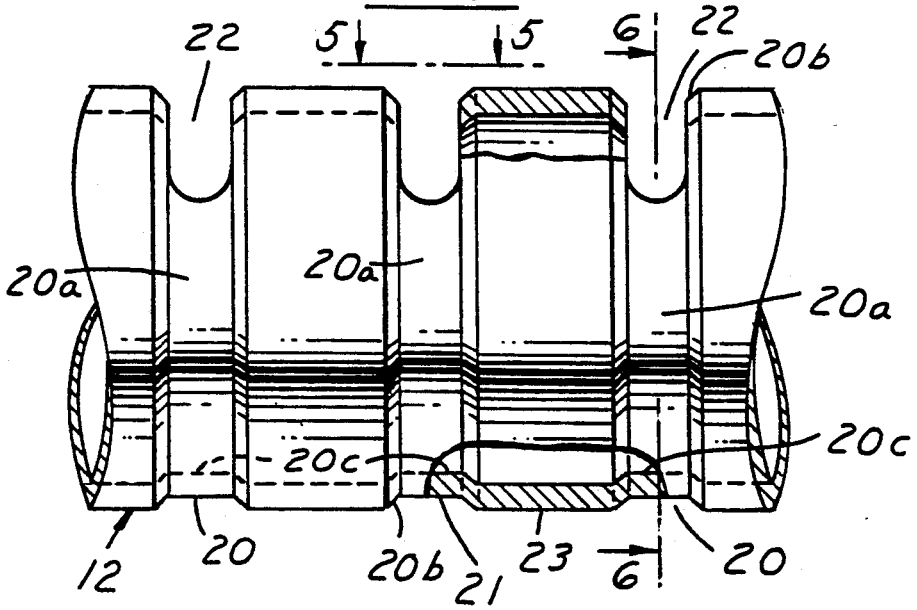
FIG. 4 is a fragmentary part-sectional view on an enlarged scale of the formed and punched header tube.

As seen most clearly in FIG. 4, the header tube can be said to be made up of a series of short tube portions 21 integrally interconnected by enlarged portions 23. The grooves and ribs function to strengthen the tubing to prevent collapse when the slots 22 are formed by a punching operation.

Figure 5:
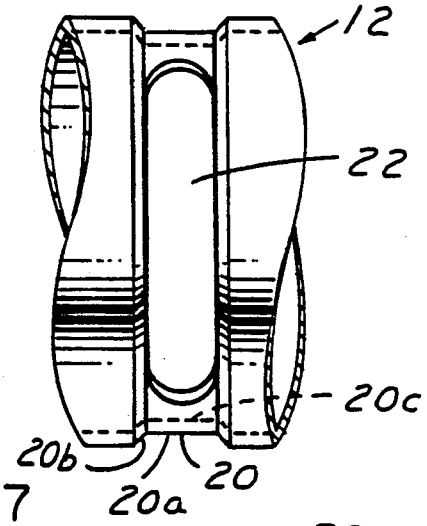
FIG. 5 is a view taken along the line 5—5 in FIG. 4.

As seen in FIGS. 5 and 6, each slot 22 is formed with a chamfer 24 at its ends which, together with the inclined surfaces 20*b*, facilitate insertion of a plurality of flat tubes 18 simultaneously by an assembly machine such as shown in U.S. Pat. No. 5,014,422 incorporated herein by reference. The ends of the slots 22 also have a surface area 25 for brazing or otherwise bonding the ends of the flat tubes 18 to the header tubes 12, 14. The width of the slot 22 extends substantially across the entire base of the groove 20.

Figure 9:
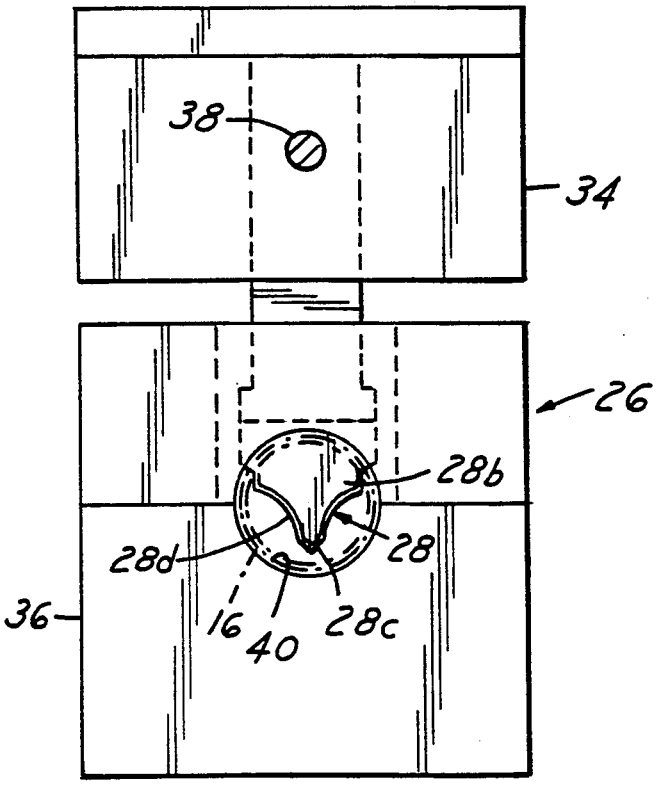
FIG. 9 is an end view of a punching assembly.
Figure 10:
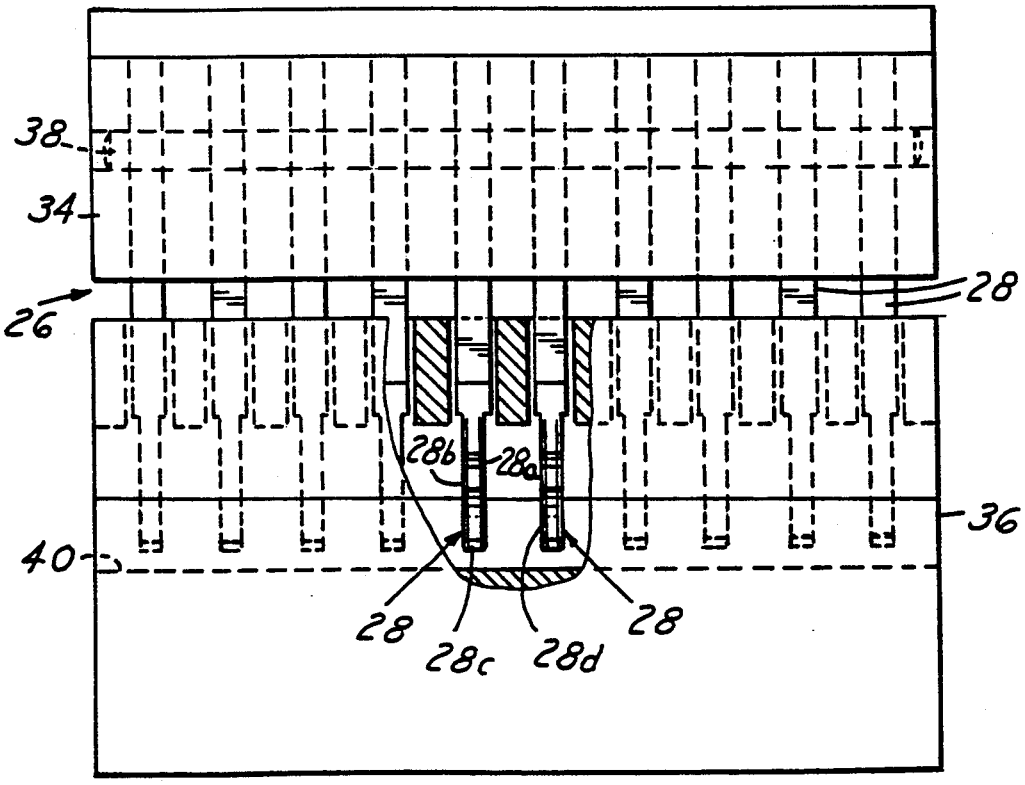
FIG. 10 is a part-sectional elevational view of the punch assembly.

FIGS. 9 and 10 illustrate the punch assembly 26 used in the formation of the elongated slots 22. As seen in FIG. 10, a plurality of punches 28 are mounted on a ram 34 by a common means such as a mounting rod 38 extending through an opening at the upper end of each punch 28. The ram 34 and the punches 28 are reciprocated in a vertical movement guided by a stationary die 36 which supports the tubes in a semicylindrical groove 40 for receiving the header tube during the punching operation. The ram 34 is operated by any known power means (not shown).

Each punch comprises front and rear surfaces 28*a*, 28*b* having a punch point 28*c* for the initial shearing of the header tube and has an upward and outward taper 28*d* extending therefrom for punching the elongated slot 22 with rounded ends. The punch point 28*c*, upon downward movement of the ram 34, initially pierces the tube. As the ram 34 moves further downward the taper 38*d* progressively punches the slot.

After assembly, the heat exchanger is usually passed through an oven to cause the various components to be bonded to one another by brazing in a known manner.

It can thus be seen that there has been provided a heat exchanger with improved headers and a method of making such headers; a heat exchanger with header tubes whose surface has been strengthened to withstand a punching operation to form slots therein without the need to pressurize the inside of the headers and to prevent collapse thereof during the punching operation; a header tube which facilitates insertion of a plurality of tubes simultaneously; and which assume a high quality, leak-free, braze bond between the flat tubes and the header tubes.

What is claimed is:

1.

A heat exchanger comprising a pair of tubular opposed parallel header tubes, a plurality of longitudinally spaced annular grooves around an outer surface of each said header tubes with inclined sides and a base on an external surface of the groove and spaced annular ribs on an inner surface opposite the grooves, a slot in the base of each said groove, said slots in one of said header tubes being in alignment with said slots in the other of said header tubes, a plurality of elongated flat tubes with open ends extending between said headers wherein the open ends of said flat tubes are received within said slots, such that a leakfree braze bond can be obtained between the flat tubes and header tubes, fins disposed between adjacent flat tubes, said header tubes, fins, and flat tubes being bonded to one another.

2. A heat exchanger set forth in claim 1 wherein said slots comprise rounded ends having a chamfer thereon to facilitate insertion of said flat tubes.

3. A method of making a heat exchanger comprising providing at least two elongated circular header tubes, deforming said header tubes at longitudinally spaced locations along a length thereof to form grooves, longitudinally spaced annular grooves with inclined sides and a base on an external surface of the groove and spaced annular ribs on an inner surface opposite the grooves, punching slots in the base of said grooves, providing a plurality of elongated, flat tubes with open ends, aligning said open ends of sid flat tubes with said slots in said header tubes, and simultaneously inserting each said open end of said plurality of flat tubes into said slots of said header tubes such that a leak-free braze bond can be obtained between the flat tubes and header tubes.

4. A method set forth in claim 3 wherein said grooves are formed by rolling.

5. A header tube for receiving a flat tube comprising an elongate header tube, a plurality of longitudinally spaced flat annular grooves around the periphery of each said header with inclined sides and a base on an external surface of the grooves and spaced annular ribs on an inner surface opposite the grooves, and a slot in the base of each said groove in the surface of said header.

6. The header tube set forth in claim 5 wherein said slots comprise rounded ends having a chamfer thereon to facilitate insertion of said flat tubes.

7. A method of making a header tube comprising the steps of providing an elongated cylindrical header tube, deforming said header tube at longitudinally spaced locations along a length thereof to form grooves with inclined sides and a base on an external surface of the groove and spaced annular ribs on an inner surface opposite the grooves, and punching slots into the base of the grooves such that a leak-free braze bond can be obtained between flat tubes and said slots of said header tube.

8. A method set forth in claim 7 wherein said grooves are formed by rolling.

* * * * *